US005906845A

United States Patent [19]

Robertson

[11] Patent Number: 5,906,845

[45] Date of Patent: May 25, 1999

[54] FLAVORING DEVICES

[76] Inventor: James P. Robertson, Heath Hill, Hillside Road, Stromness, United Kingdom, KW16 3BS

[21] Appl. No.: 08/569,780

[22] Filed: Dec. 8, 1995

[30] Foreign Application Priority Data

Dec. 9, 1994 [GB] United Kingdom ..... 9425032

[51] Int. Cl.[6] ..... A23F 5/26; A23F 3/18

[52] U.S. Cl. ..... 426/80; 426/77; 426/82; 426/84; 426/112; 426/433; 426/435; 426/431; 99/295

[58] Field of Search ..... 426/432, 433, 426/434, 435, 402, 430, 77, 80, 82, 112, 84, 431; 99/295

[56] References Cited

U.S. PATENT DOCUMENTS

| | | | |
|---|---|---|---|
| 1,412,388 | 4/1922 | Clermont | 426/77 |
| 1,601,671 | 9/1926 | Bonell | 426/77 |
| 2,073,339 | 3/1937 | Eberts | 426/402 |
| 2,123,054 | 7/1938 | Lamb et al. . | |
| 2,127,782 | 8/1938 | McShane | 426/402 |
| 2,334,171 | 11/1943 | Carter | 426/432 |
| 2,368,113 | 1/1945 | Carter | 426/432 |
| 2,686,130 | 8/1954 | Roberts | 426/402 |
| 3,083,101 | 3/1963 | Noury | 426/77 |
| 3,193,388 | 7/1965 | Conrey | 426/77 |
| 3,199,437 | 8/1965 | Nelsen | 426/77 |
| 3,244,531 | 4/1966 | Clinton et al. | 426/432 |
| 3,549,380 | 12/1970 | Patel et al. | 426/432 |
| 3,642,499 | 2/1972 | Castell . | |
| 3,935,318 | 1/1976 | Mihailide | 426/80 |
| 4,211,156 | 7/1980 | Zimmerman | 426/80 |
| 4,234,613 | 11/1980 | Lewis | 426/430 |
| 4,699,794 | 10/1987 | Brice | 426/433 |
| 4,701,333 | 10/1987 | Margolis et al. | 426/434 |
| 4,734,291 | 3/1988 | Raffensperger | 426/402 |
| 4,806,369 | 2/1989 | Thompson | 426/433 |
| 4,806,375 | 2/1989 | Favre | 426/433 |
| 4,867,993 | 9/1989 | Nordskog | 426/77 |
| 5,470,601 | 11/1995 | Robertson | 426/112 |

FOREIGN PATENT DOCUMENTS

| | | | |
|---|---|---|---|
| 424 157 A1 | 4/1991 | European Pat. Off. . | |
| 2-97355 | 4/1990 | Japan | 426/433 |
| 1601335 | 10/1981 | United Kingdom | 426/77 |
| 18325 | 9/1983 | United Kingdom | 426/82 |

OTHER PUBLICATIONS

Patent Abstract of Japan, Ground Powder of Coffee—Inventor: Takao Matsubara, Appln.(No. 56–198977,) Filed Dec. 10, 1981, Abs Grp No.: C184, Abs vol. No.: vol. 7, No. 201, ABS Pub Date: (Sep. 6, 1983,) Intl. Cl: A23F 5*14.

Patent Abstract of Japan, Coffee Liquor—Inventor: Toshio Suzuki, Appl. (No:60–18769,) Filed: Feb. 4, 1985, Abs Grp. No: C394, Abs vol. No.: vol. 10, No. 390, Abs Pub Date: (Dec. 26, 1986,) Int–Cl: C120 3*04.

Patent Abstract of Japan, Production of Coffee Shochu (Low Class Distilled Spirit), Inventor: Toshiji Inudou, Appl. (No: 60–176257,) Filed: Aug. 10, 1985, Abs Group No: C435, Feb. 11 1991 16:09:19, Abs vol. No.: vol. 11, No. 222, Abs Pub Date: (Jul. 18, 1982,) Int–Cl: C120 3*04.

*Joy of Cooking,* Irma S. Rombauer, Marion Rombauer Becker, Illustrated by Ginnie Hofmann and Ikki Matsumoto, 1975, The Bobbs–Merrill Company, Inc., Indianapolis/New York, pp. 38–39.

*Primary Examiner*—Steven Weinstein

*Attorney, Agent, or Firm*—Townsend and Townsend and Crew LLP

[57] ABSTRACT

Methods and devices for flavoring liquids are disclosed. Flavoring solids such as particulate coffee solids are packed into an impermeable container, preferably occupying most or all of the available volume. Absorbed in the solids is a quantity of extractant liquid, preferably alcoholic liquor but others are possible. The amount of extractant is no more than can be taken up by the solids; there is no free liquid. The extractant pre-extracts flavoring components from the solids. One or more seals are removable to expose openings of the container. The openings may be closed by an integral filter, or a filter may be provided by an auxiliary device which holds the container. With the seals removed, the solids charge can be rinsed with liquid to be flavored, washing out the pre-extracted flavoring components.

22 Claims, 5 Drawing Sheets

FLAVORING DEVICES

FIELD OF THE INVENTION

This disclosure has to do with devices and methods for flavoring liquids. I am particularly concerned with making drinks, but these proposals are not necessarily limited to that.

Tea and coffee bags are well-known devices for flavoring, i.e. making beverages. More sophisticated variations on the teabag concept have been disclosed. See for example U.S. Pat. No. 4,806,369 of Thompson and U.S. Pat. Nos. 3,193,388 and 2,123,054 of Conrey and Lamb respectively.

BACKGROUND OF THE INVENTION

In my U.S. Pat. No. 5,470,601 I describe a flavoring device which is a squeezable plastic bottle containing particulate flavoring solids macerating in alcoholic liquor. Coffee and whisky were examples given. The bottle neck has a removable foil seal and a built-in filter. To make the drink the seal is pulled off and coffee-flavored whisky dispensed through the filter into a cup of hot water. Flavor can be adjusted by sucking water from the cup back into the container through the filter, to wash the solids, and dispensing it again.

SUMMARY OF THE INVENTION

It is an object of the invention to provide new and useful flavoring devices and methods.

One particular object is a flavoring device enabling fast, convenient preparation of an alcoholically flavored beverage.

Another particular object is a flavoring device enabling fast preparation of even a non-alcoholic drink or flavored liquid, manually or by machine.

A first aspect relates to a method, by which a flavored liquid is made. A charge of flavoring solids—typically particulate—is put in a container with a charge of an extractant liquid for extracting one or more flavoring components from the solids. The extractant liquid is included in no greater amount than can be taken up by the solids, so that essentially no free (separately flowable) liquid is present. Preferably the liquid and solids are not combined until the individual charge for that container is formed. The container—preferably a single-serving size or other size that will be used all at once—is sealed and left for a period of time during which the flavoring component(s) are freed into the absorbed liquid. The container is then opened and the charge is flushed with a volume of liquid to be flavored, washing out the extractant liquid and accompanying flavoring component(s).

Preferably the flavoring charge (solids and absorbed and/or adsorbed liquid) occupies the sealed container as a continuous bed or packed mass, to reduce loss of components by volatilization. In particular, the charge desirably fills most or substantially all of the sealed container.

Compared with the disclosure of U.S. Pat. No. 5,470,601, these proposals involve relatively small proportions of liquids; the charge is also closely confined. Flavorings with a low content of the extractant liquid (alcoholic or whatever) are obtainable. Indeed, the extractant may be water. The flavoring component(s) is/are pre-extracted in a sealed environment by the taken-up extractant liquid, making the subsequent extraction into the bulk liquid rapid, convenient and controllable. At the same time, every flavoring component available from the solids can be retained for use.

I also propose new flavoring devices for providing a compact flavoring charge which is subsequently to be washed or flushed through with a liquid to be flavored. The devices have broader uses, however.

One such aspect is a flavoring device using in cooperation a sealed cartridge having an openable wall and containing a flavoring charge, and a liquid access control housing which can hold the cartridge with the wall open and provides one or more liquid access openings through which liquid to be flavored can flow into and out of the cartridge via the opened wall, there being also a restricted outlet functioning as a filter, which may be comprised in the housing, to retain solids of the flavoring charge within the housing.

The cartridge may have openable wall portions at opposed locations, e.g. opposite ends or sides thereof. Liquid may flow in through one and out through the other. The cartridge may have at least one non-openable wall portion, which may separate first and second openable portions and define a fluid flow conduit between them through the cartridge. It may also provide mechanical support (e.g. rigidity) for the openable portions if these are not self-supporting. Openable wall portions may be provided by removable and/or rupturable layers or films covering openings in a surrounding impermeable wall. A foil seal is one example.

One particular proposal for a flavoring cartridge has a relatively inflexible and impermeable wall, preferably of plastics material and preferably in cylindrical or other generally tubular form, defining opposed end openings each sealed by a removable or rupturable closure, e.g. a layer such as a film or foil.

The solids composition may be varied along the cartridge, so that different flavorings or degrees of flavoring are associated with different regions of the cartridge's interior. For example, one end of the cartridge might be charged only with ground coffee, the other with a different flavoring, e.g. ground figs, to flavor the coffee. An accustomed user can control the blending of these flavorings by the manner of washing out.

Another possibility is that the cartridge contains within it one or more filters to prevent the escape of solids. These may be provided as filter layers secured across openings of the cartridge, or the solids may be enclosed in a liquid-permeable bag within the cartridges.

The flavoring cartridge is in itself an independent aspect of my proposals.

The filter in the device may be part of the housing, to keep the cartridge simple.

The housing may have an opener for opening the wall of the cartridge when installed, e.g. by a seal-breaker element of the housing. This element may be a fixed portion of the housing, rupturing the cartridge wall as an installation movement brings them into engagement.

The housing may have a front portion and a rear portion. The front portion fits onto the front of the cartridge and defines a front access opening; the rear portion fits onto the rear of the cartridge and defines a rear access opening. These openings can communicate with respective front and rear openable wall portions of the cartridge. The front portion and/or the rear portion may comprise a solids-retaining filter as a part thereof.

The housing may provide a pump or other connection for forcing a flow of liquid over the flavoring charge in the cartridge; for example, a rear portion of the housing may have a chamber whose volume is controllably alterable to force flow through the cartridge. A resiliently squeezable enclosed bulb is suitable: other possibilities will occur to the skilled reader.

Additionally or alternatively the housing may be formed as a plunger with an immersible portion which holds the cartridge and has the necessary liquid access opening(s) and filter(s). This portion is immersed in a body of the liquid to be flavored, and flow through the cartridge is encouraged by relative movement, e.g. agitation. The housing may have a handle or tether on the immersible body for manipulation to this end.

The cartridge may be a discrete element. It may be adapted for disposal after one use, or may be re-usable by having the openable wall made reclosable.

A more specific proposal is a flavoring device having (i) a cartridge having first and second openings with respective rupturable seals at opposed ends thereof, and containing a charge of flavoring material (e.g. as specified above);

(ii) a housing to hold the cartridge, comprising (a) a first housing portion having a first connector detachably engageable over the first opening of the cartridge, a first seal breaker to rupture the first cartridge seal when so engaged, preferably at least one first liquid access opening to communicate with the first cartridge opening, and preferably a first filter to prevent escape of solids from the cartridge through the first liquid access opening(s), and (b) a second housing portion having a second connector detachably engageable over the second opening of the cartridge, having a second seal breaker to rupture the second cartridge seal when it is engaged, at least one second liquid access opening to communicate with the second cartridge opening, and a second filter to prevent escape of solids from the cartridge through the second liquid access opening(s).

One housing portion may be a nozzle, or a grid or mesh, or entirely open except for the filter.

The other may be similar, or may comprise a handle, grip or flexible tie or tether. It may comprise a pump, e.g. a resiliently compressible bulb, in communication with the liquid access opening(s).

A seal breaker may be provided as a cutter or other projecting element extending across in front of a filter layer, or even as part of a filter layer where the latter has sufficient rigidity.

Another proposal is that a cartridge as described be used as a flavoring source in an automated drinks dispenser. Conventional coffee dispensers, for example, use either pre-brewed coffee—which soon deteriorates in flavor by the degradation of flavor components and their loss to the surroundings—or "instant" soluble coffee which tastes different. By using the cartridge as described, the coffee solids are "pre-brewed" in a small volume of liquid within the cartridge. Nothing can escape, so the flavor is retained at this time. To make a drink of coffee, the cartridge is opened, and its contents washed with a volume of hot water in the machine, making the drink much more quickly than when brewing from scratch.

Another proposal for a cartridge is a resiliently squeezable phial of impermeable material, containing the flavoring charge with extractant liquid as explained above and having a removable seal, preferably in the form of a break-off part which, once broken off, creates an opening for liquid to be sucked into the phial and onto the flavoring charge to wash out the pre-extracted flavor. The opening is desirably a relatively restricted nozzle or spout. The break-off part may be on a closure element, e.g. a cap, fixed to close a filling opening of the phial. Filtering of particulate solids may be by a filter layer trapped behind the liquid flow opening. The filter might be fixed, e.g. trapped between a closure cap and phial rim, or associated with the flavoring charge, e.g. an enclosing filter bag containing the charge.

To be squeezable, the phial cannot be full. A compacted flavoring charge may be held in one part of the phial by a fluid-permeable retaining barrier, e.g. a resiliently-expansible filler such as a plastics foam, occupying part or all of the squeezable space. Or, the flavoring charge may be relatively compacted within a filter bag occupying only part of the phial space.

The aspects described above prefer containers adapted to be washed or flushed through with a liquid to be flavored.

The concept is not limited to such containers, however, and this disclosure puts forward further proposals within the broad concept of a flavoring product comprising a change of flavoring solids retained in an impermeable sealed container together with an extractant liquid.

In one such further aspect I provide the flavoring solids in a permeable filter container, and particularly a flexible bag such as a paper filter bag, enclosed together with the extractant liquid inside the sealed impermeable container. Desirably the extractant liquid is included in a quantity no greater than can be absorbed by the flavoring solids (which as before are typically particulate and preferably finely ground).

The container need not be specially adapted to provide for access of a liquid to be flavored. Rather, it may serve merely as a convenient enclosure from which the permeable filter container can subsequently be taken and used in preparation of a flavored liquid. So, the container may be any sealed and conveniently openable impermeable enclosure. It may be flexible, rigid, or combine flexible wall regions with less flexible or rigid wall regions. One preferred embodiment is a relatively rigid container, e.g. in the form of a tray or pot, having an opening covered by a removable flexible seal or closure layer. Such containers are readily available. Typical container materials include molded plastics, metallic foils and foil/plastics laminates. Typical sealing layer materials include metallic foils, plastic films and foil/plastics laminates, generally flexible. Sealing layers may be attached by any suitable means, e.g. heat-sealed or adhesively-sealed to the container rim.

Another possible form of closure is a sealing snap-or screw-fitting lid; this is more suitable for re-use than for a one-use-only product.

A further possibility for the outer container is a sealable impermeable flexible bag or sachet.

Preferably the flavoring charge occupies at least 25%, more preferably at least 50% and most preferably at least 80% by volume of the space inside the sealed enclosure, to ensure maintenance of contact between the solids and extractant.

It is particularly preferred to manufacture the products on an individual basis by contacting individual portions of flavoring solids with individual doses of extractant liquid before sealing them into their impermeable enclosures. This ensures that all of the flavoring components are retained for each portion, and provides flavoring results which are greatly superior to those achieved by bulk preparation of solids with absorbed extractant. This applies to all the above aspects.

BRIEF DESCRIPTION OF THE DRAWINGS

Particular embodiments of my proposals are now described as examples, with reference to the accompanying drawings in which.

DESCRIPTION OF THE PREFERRED EMBODIMENT

FIGS. 1 to 4 show various proposals for cartridges for making drinks.

Figure 1A:
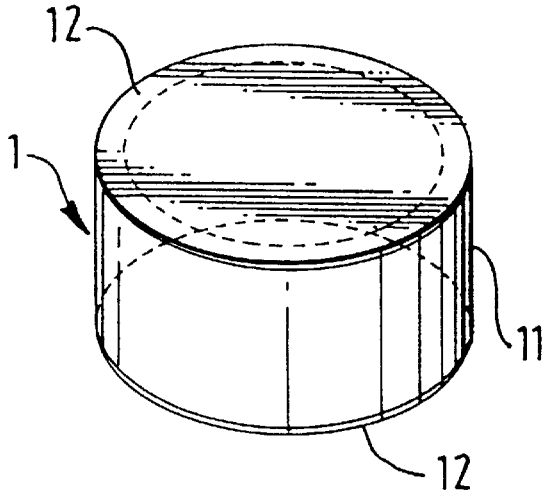
FIGS. 1(*a*), 1(*b*), 2(*a*), 2(*b*), 3 and 4 show forms of flavoring cartridge.
Figure 1B:
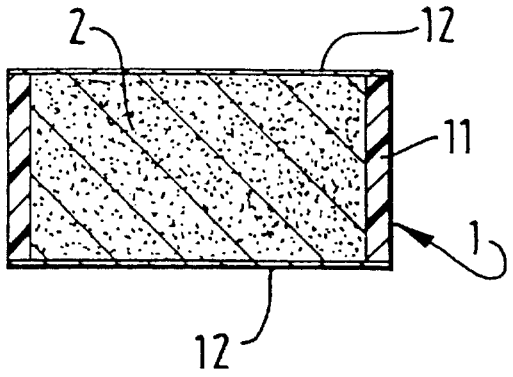

The embodiment of FIG. 1 is a cartridge 1 having a short cylindrical plastic tube 11 open at both ends, and each end closed off by a heat-sealed foil layer 12. Sealed inside the tube is a charge 2 of flavoring material, in this case ground coffee of medium grain size. Charged into the cartridge with the coffee is a small volume of liquid, e.g. sterile water, whisky or other alcoholic spirit, which is entirely taken up by the solids so that no free liquid is present. The charge 2 completely fills the cartridge 1.

Figure 2A:
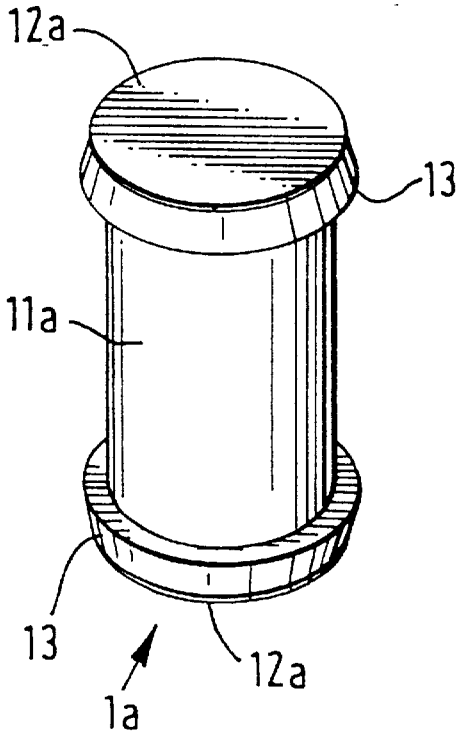
Figure 2B:
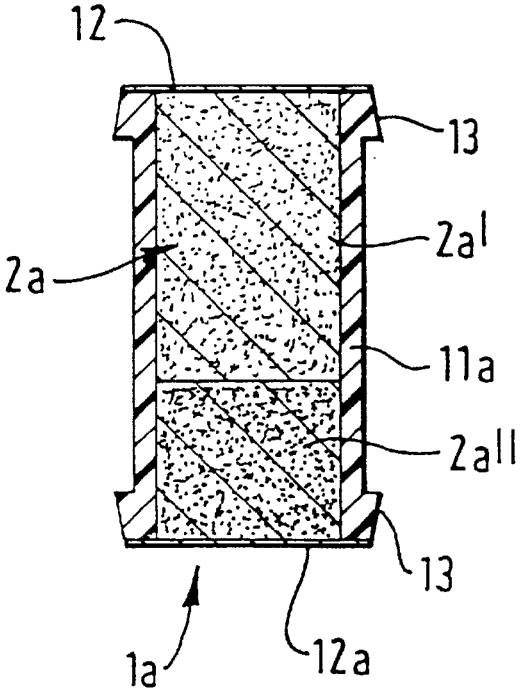

FIG. 2 shows a modified version in which, unlike FIG. 1, the tube 11a is longer than it is wide. The foil seals 12*a* are the same as before. A snap rib 13 is formed on the tube around its top and bottom openings. The flavoring charge 2*a* is in two parts; a top part 2*a*' which is ground coffee with taken up water as in FIG. 1, and a bottom part 2*a*" which is different, e.g. ground FIGS. Again, the two portions entirely fill the cartridge 1*a* and there is no free liquid, so that the two portions 2*a*', 2*a*" continue to reside in separate parts of the tube. The function of the snap ribs 13 is explained below.

Figure 3:
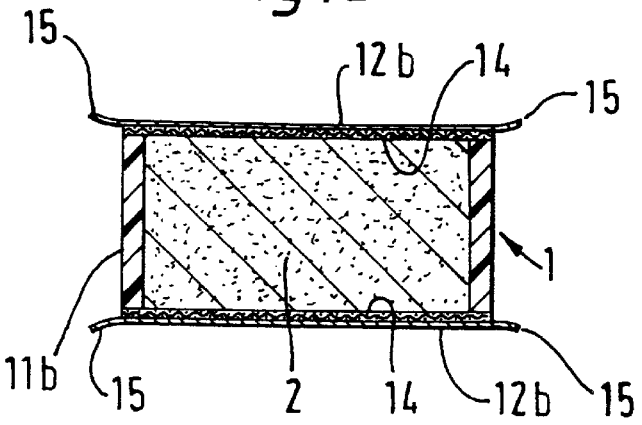

FIG. 3 shows a third version, similar to that of FIG. 1 except that synthetic mesh or other suitable filter layers 14 are fixed across the end openings of the tube 11*b* and covered by the impermeable foil seals 12*b*. Here the foil seals 12*c* are formed with tabs 15 so that they can be pulled off without disrupting the filter layers 14.

Figure 4:
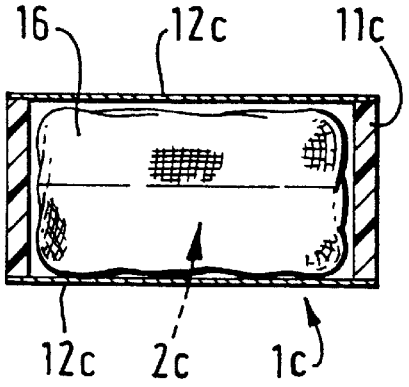

FIG. 4 shows a fourth cartridge 1*c*, again including an internal filter. The outer part of the cartridge is as in FIG. 1, with a plastic tube 11*c* and foil end seals 12*c* closing off its end openings. Here however the flavoring charge 2*c* is entirely enclosed in a permeable paper bag 16, although again this substantially fills the interior space of the cartridge. The material of the paper bag 16 is of the type conventionally used for tea bags and coffee bags, and is well-known to the skilled person.

It should be understood that the nature of the solids in the flavoring charge 2 may vary. Coffee is a particular example, as mentioned. Other examples are tea, cocoa, herbs, seeds, roots, berries, fruits, sugars and even dairy products. They may be flavorings useful in drinks and/or in food, e.g. for cookery. However the solids are preferably in particulate form and preferably substantially fill the cartridge. In each case a volume of pre-extractant liquid is added to the solids, preferably at the time when they are loaded into the cartridge, and this volume is such as can be taken up by the solids without leaving free-flowing liquid.

The volume of the cartridge may vary according to the contents and their purpose, but typically will be between 2 and 30 mL, more usually between 5 and 20 mL.

The materials and shape of the cartridge are not critical. A tube open at both ends is preferred. Easily-molded plastics such as polypropylene is a suitable material for the tube wall. The tube may be cylindrical, but other shapes are possible. Equally, while a tube open at both ends is preferred, a cartridge with only one opening, or with more than two, is viable.

The foil seals 12 are just one example of an impermeable film covering for the opening. Any covering may be used provided that it is rupturable by the means to be used, and provided that it substantially retains the flavoring components involved. This can be determined easily by trial and error, but in fact a foil seal will serve for most purposes.

Figure 5:
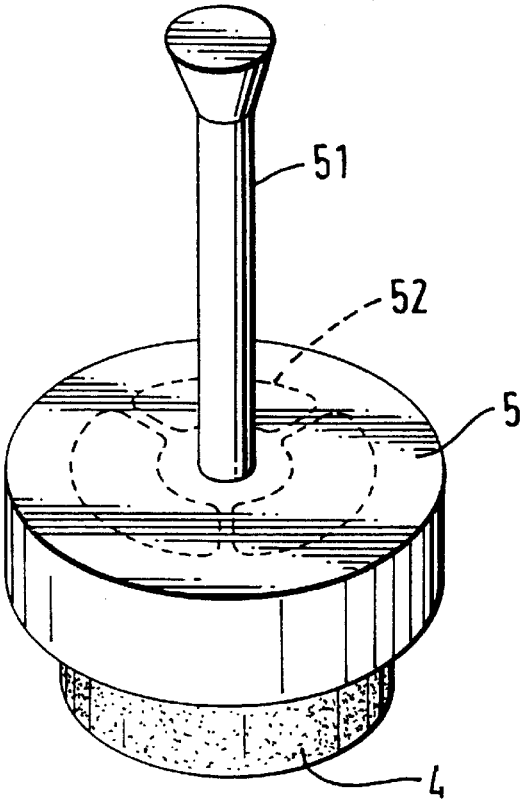
FIG. 5 is a perspective view of a flavoring device in the form of a hand-held plunger.
Figure 6:
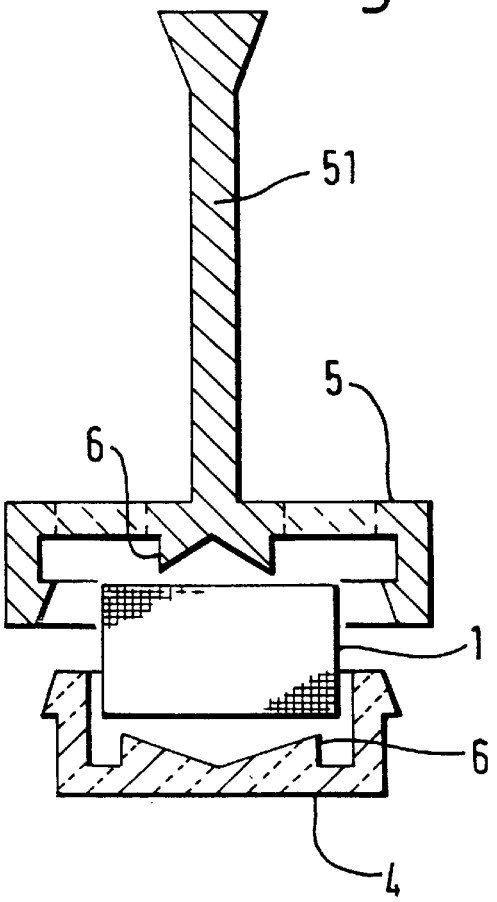
FIG. 6 is a vertical axial sectional view of the FIG. 5 device, with components disassembled.

FIGS. 5 and 6 show a device which can be used to make a flavored liquid (e.g. a drink) using cartridges e.g. as shown in FIGS. 1, 3 and 4. This device takes the form of a plunger, to be manually immersed in hot water. The plunger has a bottom cup 4 which snap fits into a top cap 5 having a handle stem 51 extending up from it. In this case they are formed together as a one-piece molding. The cap 5 may be impermeable, or may have openings 52 (shown in broken lines).

The cup 4 is a liquid-permeable component. It may be shaped from a porous material, e.g. a porous ceramic. Such are commercially available, e.g. under the trade mark ALUNDUM@. This material, while porous, is also relatively hard. Alternatively, the cup 4 may be formed from impermeable material with openings to allow liquid to pass, the solids-retaining filter being provided within.

The interior of the cup 4 and, in this case, also the interior of the cap 5, have seal-breaker formations 6. These are integrally-molded pointed teeth or projections, directed onto the space defined between the cup 4 and cap 5.

In use a cartridge 1, e.g. as described in FIGS. 1 to 4 is put in the cup 4 and the cap 5 snapped onto the cup. By this action the teeth 6 break through the top and bottom seals 12 of the cartridge. The plunger can now be immersed in hot water, e.g. in a cup, holding the stem 51, and agitated so that water flows through the permeable parts and consequently through the flavoring charge in the cartridge 1.

During the period of storage of the cartridge 1, soluble flavoring components have been freed to some extent from the solids into the taken-up liquid. When the bulk liquid washes through the cartridge 1 on immersion, these freed components are washed out relatively easily, and much more quickly than would occur with immersing dry solids in hot water. Furthermore, although the solids are "pre-brewed", they have at all times during the pre-brewing been enclosed in the sealed cartridge so that no components have been lost; even volatile flavors are retained. Thus, the pre-brewing does not lead to the flat taste associated with coffee that has stood too long in a jug.

It will be understood that, where the cartridge 1 includes its own internal filtration means (as in FIGS. 3 and 4), the housing formed by the plunger or other device need not include any filter for retaining the solids. They will be retained by the cartridge's own filter. Accordingly, the housing of the device can have any openings adapted to provide a flow of liquid through it, together with means for rupturing one or more seals of the cartridge as appropriate. In the FIG. 3 design of cartridge 1 the seals may be pulled off, or the filters may be positioned so as not be damaged by rupture of the seals.

Figure 7:
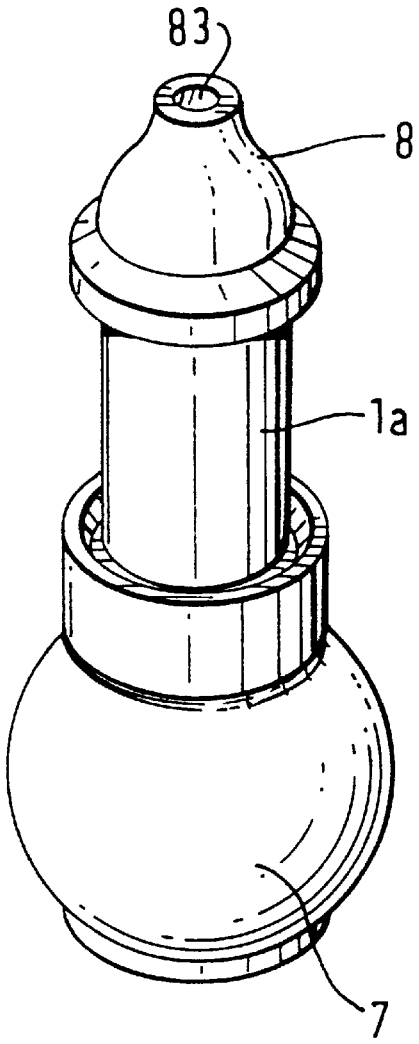
FIG. 7 is a perspective view of a flavoring device having a hand-operated pump.
Figure 8:
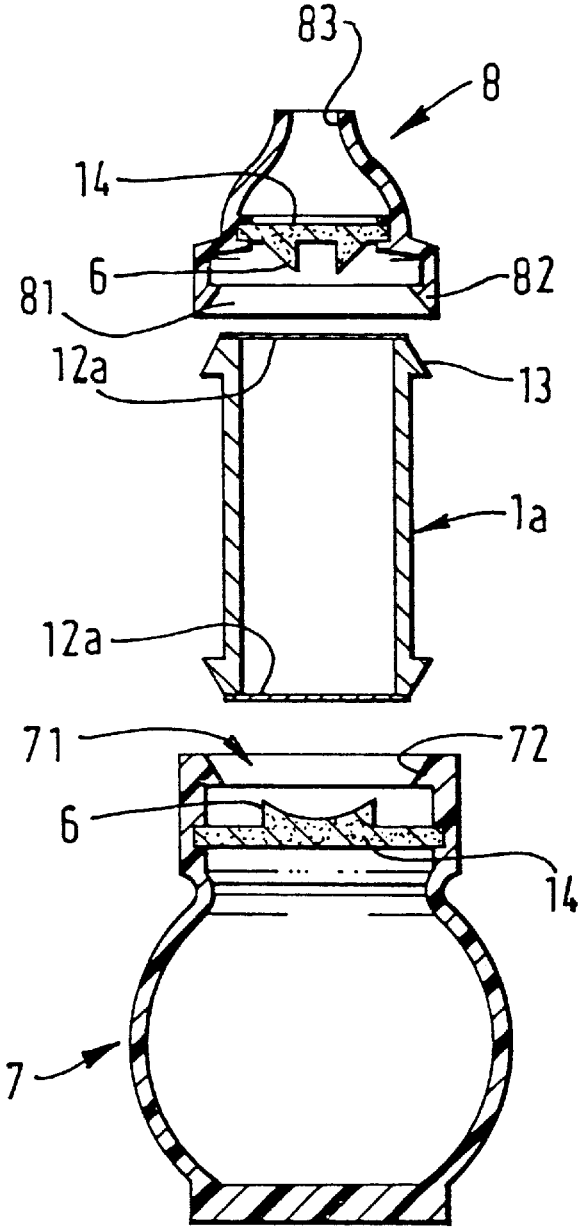
FIG. 8 is a vertical axial sectional view of the FIG. 7 device with components disassembled.

FIGS. 7 and 8 show a more sophisticated device. Here the cartridge la has snap ribs 13 as were shown in FIG. 2, and it may have sub-divided contents as were also described in relation to FIG. 2. The device consists of a pump element 7 and a nozzle element 8. Each has an opening 71, 81 with a respective snap rib or bead 72, 82 adapted to fit over and clip onto a respective end of the cartridge 1*a*. Spanning each opening 71, 81 is a filter layer 14, in this case formed of porous rigid material as mentioned above with projecting teeth integrally molded to function as seal-breakers. With the cartridge end snapped into the opening, the seal breaker 6 ruptures the associated cartridge seal 12*a;*

The pump component 7 is in essence a small bulbous container, e.g. of a volume from 10 to 60 mL, and is resiliently squeezable. It may be made of any appropriate resilient plastics or rubbery material, e.g. polypropylene.

The nozzle component may be made of the same material. It has a relatively restricted opening 83 on the other side of the filter 14, and functions to carry the filter 14 and provide a controllable inlet/outlet opening for liquid flow.

The one-piece filter/breaker units 14 shown are just one possibility. The filter and seal breaker functions may equally well be performed by separate components. The filter might be for example a textile mesh and the seal-breaker a formation formed integrally with the plastics of the nozzle and bottle components 8, 7.

In use a cartridge la is selected and its ends snapped into the openings 71, 81 of the container 7 and nozzle 8, rupturing the associated seals 12*a*. A drink is prepared by squeezing the container 7, immersing the nozzle opening 83 in a container of hot water, releasing the container 7 to suck hot water through the cartridge contents and, to the extent desired, back into the container 7, and then squeezing the container 7 again to discharge the (now flavored) water through the nozzle opening 83 and back into the container (or perhaps into some other container).

The effects of pre-brewing of the cartridge contents are as mentioned previously.

Where the cartridge has different contents at different parts, with practice a user can control the blending of flavors from these different parts by adjusting the degree to which liquid is sucked into the cartridge. Furthermore, the cartridge is generally reversible, so that control can be exercised by turning it round.

The examples above refer to manually-operated devices, but the use of these cartridges is also proposed in drink-making machines, e.g. automatic dispensing machines. The machine has a loading station where the flavoring cartridge is inserted, with simultaneous or subsequent rupturing of seals if these have not already been removed. The loading station is on a liquid flow path through the machine, which will also have one or more filters (if these are not built into the cartridges), and the machine will have means for pumping liquid along the flow path, through the cartridge and filter(s) and thence to an outlet. The machine may then automatically eject the cartridge to be ready for another one.

This proposal takes advantage of the "pre-brewing" that can occur with cartridges loaded as described above. Whereas a conventional coffee dispensing machine must dispense either ready-brewed beverage (which rapidly loses its favor) or else brew coffee from scratch (which is very slow), the present proposal enables the flavor of a freshly brewed drink to be achieved in a short time. The drinks need not be esoterically-flavored. While alcoholic liquors such as whisky, brandy and various liqueurs are possible, the technique works perfectly well with water alone, achieving the pre-brewing effect. Pure or sterile water should preferably be used, to give the cartridges a useful shelf-life. Where alcohol is present shelf-life is not a problem.

The cartridges are conveniently mass-produced on a production line basis. For example, the following packing sequence is easily automated.

(1) Provide a conveyed series of open plastic tubes.

(2) Apply sealing films to one opening of the tubes and position them open and uppermost.

(3) Charge a dose of flavoring solids into the tube through the opening.

(4) Charge a dose of liquid (in a volume that can be taken up by the solids) into the tube, either at the same time as or after charging with the solids.

(5) Apply a seal to the remaining opening.

TEST EXAMPLE

In tests, I sealed small cylindrical polypropylene tubes of 15 mL capacity at one end with an aluminum foil seal, charged it with 5 g of medium grain ground coffee and then with 5 mL 40% whisky, which was entirely taken by the solids. The flavoring charge filled the tubes. I then sealed the other end and stored the tubes.

After one or two weeks (depending on the temperature and ground size) I found that the various components (flavors, oils, acids, etc.) in the coffee had been freed sufficiently to be extracted very quickly by hot water. Thus I used a device as described above in relation to FIGS. 7 and 8. A coffee drink, in effect fully brewed, was obtained in less than half a minute.

Figure 9:
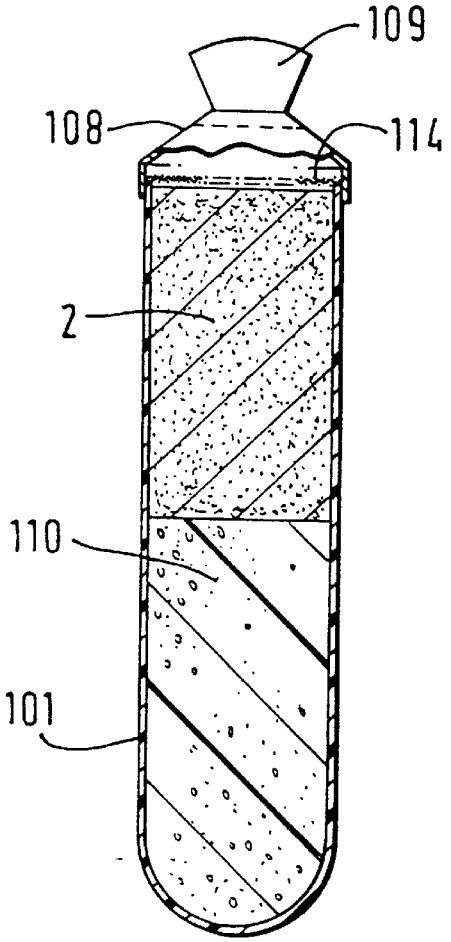
FIG. 9 is a sectional view of a squeezable phial having a foam filler.
Figure 10:
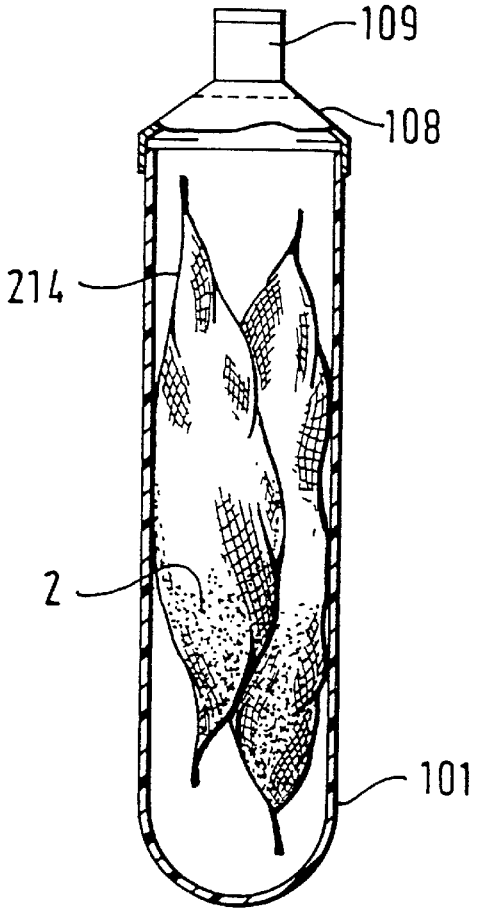
FIG. 10 is a sectional view of a squeezable phial using filter bags.

FIGS. 9 and 10 show very simple variants in which squeezability is inherent in the cartridge. A squeezable phial 101 is formed as a cylindrical tube of polypropylene, closed at one end. A closure cap 108 having a break-off part 109 plugs or screws onto the open end of the phial 101 to close it off. The break-off element 109 may be a flat tag, as in FIG. 9, or the solid end of a spout as seen in FIG. 10. Caps of this type are commercially available. Breaking off part 109 leaves an opening (at the position marked by the dotted line in the drawings) in the middle of the cap, optionally forming a spout but in each case restricted relative to the size of the open end of the phial 101.

In the FIG. 9 embodiment, the upper part of the tube is occupied by a packed coffee/alcohol flavoring charge 2 which may be as described above for the previous embodiments.

The lower portion of the tube is filled with a food-grade plastic foam or sponge filler 110, holding the flavoring charge 2 in place. A textile filter layer 113 is trapped between the phial rim and the closure cap 108. In this embodiment, the flavoring charge is 5 g of coffee with 8 mL 30% spirit taken up thereby. In use the tag 109 is broken off, the phial squeezed (compressing the foam 110), the opening immersed in hot water in a cup, and the squeeze released to draw the water in through the opening and on the flavoring charge 2. It need not necessarily be taken into the foam 110. Another squeeze then discharges the flavored water; this sequence may be repeated.

The FIG. 10 embodiment provides filtration by loading the coffee/alcohol charge into filter paper coffee bags. Here, a pair of 2.5 g bags is used, for easy loading into the phial 101 before the cap 108 is fitted. No other filter is needed; the restricted opening in the cap will not allow the bags 214 to escape as the device is squeezed.

While these embodiments have a certain volume of free internal space communicating with the flavoring charge, the entirely is nevertheless sealed in and so flavor is not lost. Furthermore, the charge may be held in compacted form, e.g. as shown.

Figure 11:
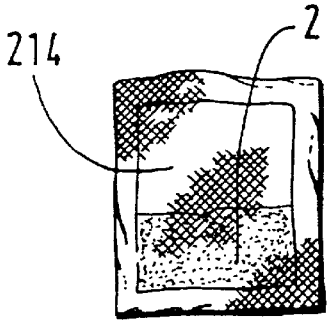
FIG. 11 shows a coffee filter bag.

FIG. 11 shows a coffee bag in the form of a conventional filter sachet 214, containing a portion, e.g. 4 g of ground coffee 2. The amount of moisture which ground coffee can absorb depends on the degree of roasting and the fineness of grinding. A 4 g single portion of medium-ground coffee will comfortably absorb 5 mL of liquid, e.g. whisky, without any excess liquid.

Figure 12:
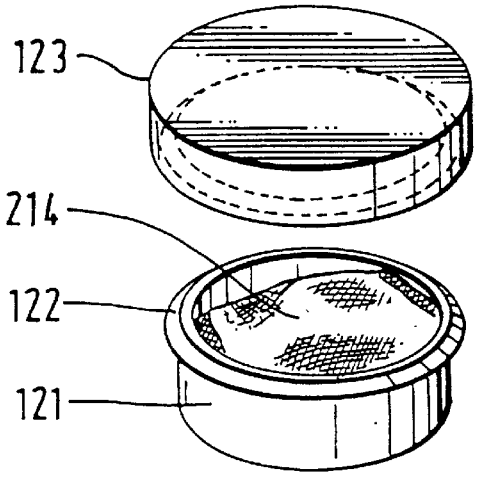
FIG. 12 shows a plastic pot and lid enclosure.

FIG. 12 shows a plastic pot 121 for containing the filter bag 214, having a snap rim 122 and a snap-on plastics lid 123 to create a substantially sealed product.

Figure 13A:
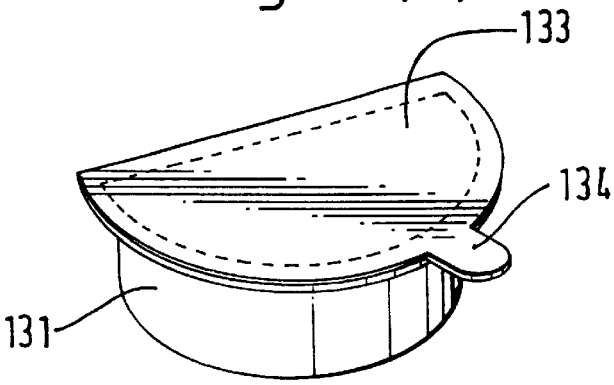
FIG. 13(*a*),(*b*) shows a foil tub with a peelable foil seal.
Figure 13B:
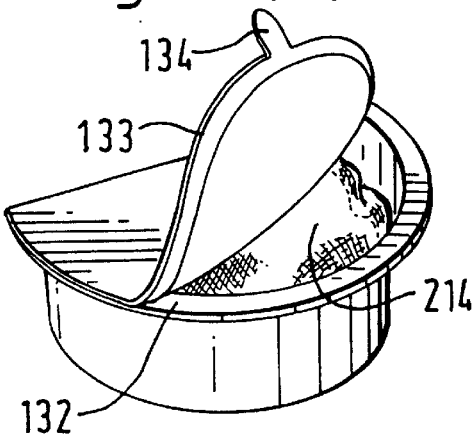

FIG. 13 shows a foil tub 131 with a flattened rim flange 132 onto which is adhesively sealed (by conventional means well known in the art) a peelable foil seal layer 133 with a grip tab 134. The seal layer 133 is substantially more flexible than the tub 131. This container is sized to hold two-alcohol-impregnated coffee filter bags 214, with a small amount of free space.

Figure 14A:
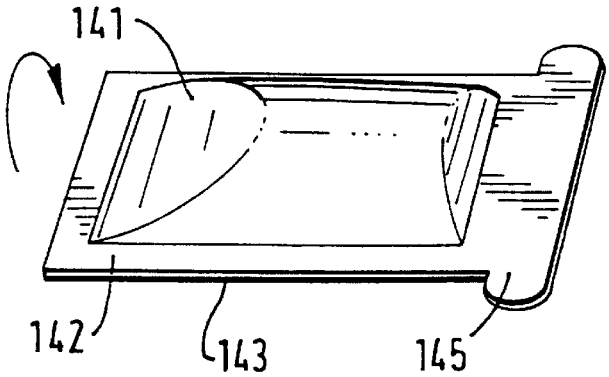
FIG. 14(*a*),(*b*) shows an injection-molded plastics tube with a foil/plastic laminate peelable seal.
Figure 14B:
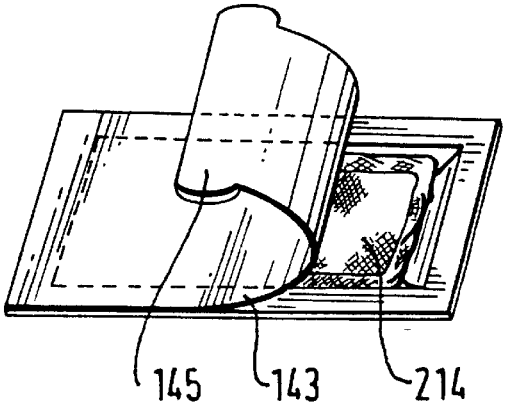

FIG. 14(*a*) shows an injection molded flat tub 141 whose rim flange 142 is provided at one end with a break-off tab 145. The extractant-containing filter sachet 214 lies in the shallow recess of the tub and is sealed in by a flexible foil laminate sealing layer 143 sealing around the flange 142 by conventional means. In this embodiment the sealing laminate 143 has an outer polymer film layer, an intermediate foil layer and an inner polymeric film layer which also forms a liner of the container recess containing the sachet to 214. The skilled man in container sealing is familiar with this technology. To open the container the tab 145 is broken off and peeled back taking the foil layer and outer polymeric film layer with it to expose the sachet 214 within for removal.

The above embodiments are all individual packages. It is also possible to use packages in a connected multiple container formation, e.g. multiple impermeable tubs, or multiple blisters on a backing sheet and individual portions of those may be separable, e.g. by breaking along prefabricated lines of weakness.

Figure 15A:
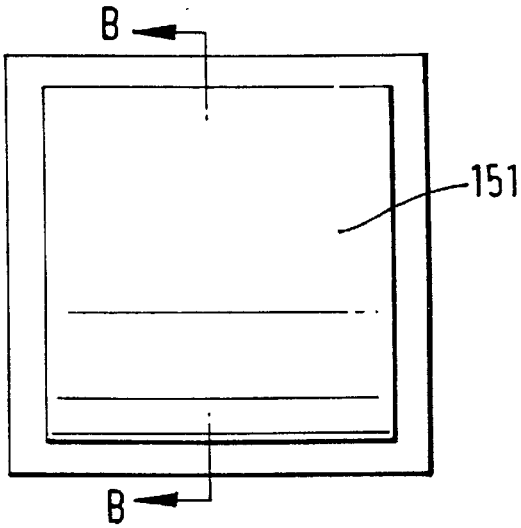
FIG. 15(*a*),(*b*) shows a foil laminate sachet.
Figure 15B:
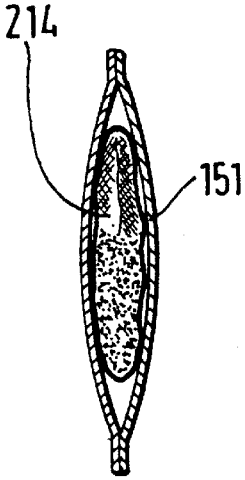

FIG. 15 shows a simple and practical embodiment in the form of an impermeable foil laminate sachet 151, consisting essentially of two foil laminate facing layers, rectangular in this embodiment, sealed together around their edges, e.g. by heat-sealing to form an enclosed pocket in which the filter sachet resides—see the sectional view of FIG. 15*b*.

The order of assembly in manufacture may be adjusted for convenience depending on the production line available, the nature of the solids and extractant liquid, etc. The permeable bag may be put in the outer container and the liquid added, and vice versa. Or, the solid in the permeable bag may be wetted with the liquid (on a portion-by-portion basis) before being put in the permeable container.

What is claimed is:

1. A flavoring device for flavoring a volume of potable liquid for a beverage, said device comprising a sealed container and a flavoring charge enclosed in the sealed container;

the flavoring charge being in compact form occupying at least 80% of the volume within the container and comprising (a) a charge of particulate beverage flavoring insoluble solids containing liquid-extractable flavor, and (b) a respective individual dose of pre-extractant liquid combined with the particulate flavoring solids at the time of filling into the container, the dose of pre-extractant liquid being substantially entirely taken up in the compact charge of particulate flavoring solids to eliminate free liquid while pre-extracting said liquid-extractable flavor from the flavoring solids into the taken-up pre-extractant liquid, and the container including at least one openable wall portion enabling the flavoring charge to be washed with a volume of potable liquid to flavor said volume of potable liquid with said pre-extracted extractable flavor while retaining said insoluble solids by means of a filter.

2. A flavoring device as claimed in claim 1 in which the openable wall portion comprises a peelable layer.

3. A flavoring device as claimed in claim 1 in which the openable wall portion comprises a rupturable layer.

4. A flavoring device as claimed in claim 1 in which the compact charge of particulate flavoring solids fills substantially all of the container.

5. A flavoring device as claimed in claim 1 in which the container has first and second said openable wall portions at opposite ends thereof.

6. A flavoring device as claimed in claim 5 in which each of said openable wall portions comprises a peelable layer.

7. A flavoring device as claimed in claim 6 in which the flavoring charge fills substantially all of the container.

8. A flavoring device as claimed in claim 5 in which each of said openable wall portions comprises a rupturable layer.

9. A flavoring device as claimed in claim 8 in which the flavoring charge fills substantially all of the container.

10. A flavoring device as claimed in claim 5 in which the container comprises respective filters at the first and second openable wall portions, to retain the particulate flavoring solids therein when said openable wall portions are open.

11. A flavoring device as claimed in claim 1 in which the container comprises a filter at said openable wall portion, to retain the particulate flavoring solids therein when said openable wall portion is open.

12. A flavoring device for flavoring a volume of potable liquid, comprising (i) a sealed cartridge and a flavoring charge enclosed in the sealed cartridge, the cartridge having first and second openings with respective rupturable seals at said openings, the flavoring charge being compact within the sealed cartridge and comprising (a) a charge of particulate potable liquid flavoring insoluble solids containing liquid-extractable flavor, and (b) a respective individual dose of pre-extractant liquid combined with the particulate flavoring solids, the dose of pre-extractant liquid being substantially entirely taken up in the compact charge of particulate flavoring solids to eliminate free liquid while pre-extracting said extractable flavor from the flavoring solids into the taken-up pre-extractant liquid; and (ii) a housing to hold the cartridge, comprising (a) a first housing portion having a first connector detachably engageable over the first opening of the cartridge and a first seal breaker to rupture the first cartridge seal when so engaged, and (b) a second housing portion having a second connector detachably engageable over the second opening of the cartridge, having a second seal breaker to rupture the second cartridge seal when so engaged, the second housing portion having at least one second liquid access opening to communicate with the second cartridge opening and provide access for a volume of potable liquid to wash through the flavoring charge to flavor said volume of potable liquid with said pre-extracted extractable flavor, the device further comprising filter means to retain said insoluble solids of the flavoring charge.

13. A flavoring device as claimed in claim 12 in which the filter means comprises respective filters at the first and second openings to retain said insoluble solids.

14. A flavoring device as claimed in claim 12 in which said first and second housing portions of the housing respectively comprise first and second filters to prevent escape of said insoluble solids.

15. A flavoring device as claimed in claim 12 in which one of said housing portions comprises a nozzle.

16. A flavoring device as claimed in claim 12 in which one of said first and second housing portions comprises a pump means for pumping said potable liquid.

17. A flavoring device for flavoring a volume of potable liquid, comprising a resiliently squeezable phial of impermeable material and a flavoring charge sealed within said phial, the phial having a restricted nozzle opening with a removable seal;

the flavoring charge comprising (a) a charge of particulate potable liquid flavoring insoluble solids containing liquid-extractable flavor, and (b) a respective individual dose of pre-extractant liquid taken up in the charge of particulate flavoring solids to eliminate free liquid while pre-extracting said liquid-extractable flavor from the flavoring solids into the taken- up pre-extractant liquid such that the flavoring charge can be washed through with a volume of potable liquid to flavor said potable liquid with said pre-extracted liquid-extractable flavor, and a fluid-permeable retaining barrier for retaining said insoluble solids of the flavoring charge for said washing and confining the flavoring charge in compact form to part of the phial interior, leaving the remainder of the phial interior as squeezable space.

18. A flavoring device as claimed in claim 17 in which the fluid-permeable retaining barrier is provided as plastics foam occupying at least part of the squeezable space.

19. A flavoring device as claimed in claim 17 in which the fluid-permeable retaining barrier is provided as a filter bag containing the flavor charge.

20. A flavoring device for flavoring a potable liquid for use as food or drink, comprising a flavoring charge which comprises (a) a charge of particulate potable liquid flavoring insoluble solids containing liquid-extractable flavor and (b) a dose of extractant liquid substantially entirely taken up in the particulate flavoring solids to eliminate free liquid while pre-extracting said liquid-extractable flavor from the flavoring solids into the taken-up pre-extractant liquid;

a paper filter bag containing the flavoring charge in compact form, and so as to retain insoluble components of the flavoring solids when the flavoring charge is washed through with a volume of potable liquid to flavor said potable liquid with said pre-extracted flavor, and a sealed impermeable container, said filter bag being contained in said impermeable container such that the flavoring charge therein occupies at least 50% by volume thereof.

21. A flavoring device as claimed in claim 20 in which the flavoring charge occupies at last 80% by volume of the sealed impermeable container.

22. A flavoring device as claimed in claim 20 in which the sealed impermeable container is a flexible sachet.

* * * * *